United States Patent [19]

Stalder et al.

[11] Patent Number: 4,934,133

[45] Date of Patent: Jun. 19, 1990

[54] METHOD OF PRODUCING A ROTATING AIR LAYER AND FALSE-TWIST AIR JET NOZZLE FOR PRACTICING SUCH METHOD

[75] Inventors: Herbert Stalder, Kollbrunn, Switzerland; Robert Ammann, deceased, late of Ohringen, Switzerland, by Claudia Amman, heir

[73] Assignee: Maschinenfabrick Rieter AG, Winterthur, Switzerland

[21] Appl. No.: 288,415

[22] Filed: Dec. 15, 1988

[30] Foreign Application Priority Data

Dec. 18, 1987 [CH] Switzerland ..... 04950/87

[51] Int. Cl.[5] ..... D02G 1/04; D01H 5/28

[52] U.S. Cl. ..... 57/333; 57/328; 28/271; 28/274

[58] Field of Search ..... 57/333, 328, 350; 28/271, 274

[56] References Cited

U.S. PATENT DOCUMENTS

| | | | |
|---|---|---|---|
| 3,425,359 | 1/1969 | Houle et al. | 57/333 X |
| 3,490,219 | 1/1970 | Ozawa et al. | 57/328 |
| 4,242,859 | 1/1981 | Lundgren | 57/328 X |
| 4,437,302 | 3/1984 | Anahara et al. | 57/333 |
| 4,569,193 | 2/1986 | Anahara et al. | 57/328 |
| 4,817,843 | 4/1989 | Sano | 28/271 X |

FOREIGN PATENT DOCUMENTS

| | | |
|---|---|---|
| 0131170 | 1/1985 | . |
| 2722319 | 1/1981 | Fed. Rep. of Germany . |
| 3526514 | 2/1986 | Fed. Rep. of Germany . |
| 3237990 | 3/1986 | Fed. Rep. of Germany . |
| WO8703310 | 6/1987 | PCT Int'l Appl. . |
| 2174723 | 11/1986 | United Kingdom . |

*Primary Examiner*—Stuart S. Levy
*Assistant Examiner*—Steven M. duBois
*Attorney, Agent, or Firm*—Werner W. Kleeman

[57] ABSTRACT

To improve the efficiency of a rotating air layer produced by an air injection nozzle and rotating in a substantially cylindrical space, the rotating air layer being intended to rotate a twisted fiber structure introduced through an inlet duct, there is provided a tube extension at the inlet duct. This tube extension forms a guide for the air flow injected tangentially and at an inclination by the air injection nozzle with respect to the direction of travel of the twisted fiber structure. As a result of this guide, the rotating air layer can form before it engages or contacts the twisted fiber structure. As a result there is increased the rotation of the engaged twisted fiber structure per unit length thereof, resulting in increased strength of the twisted fiber structure and the yarn ultimately produced therefrom with low air consumption.

17 Claims, 4 Drawing Sheets

Fig. 1
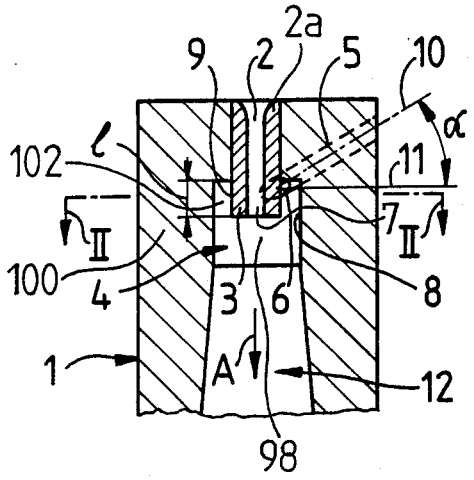
Fig. 3
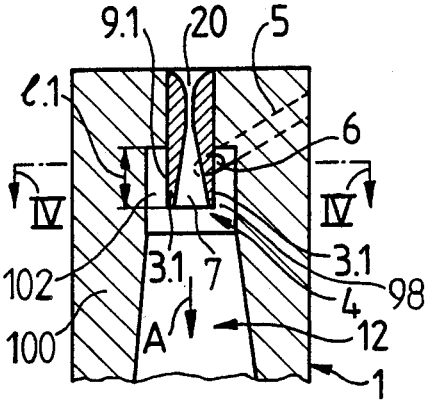
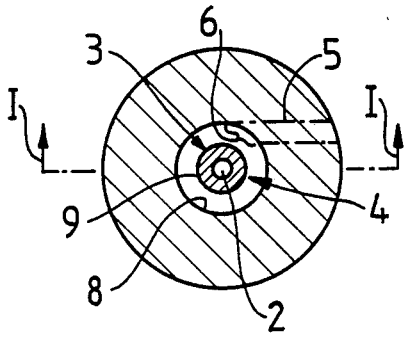
Fig. 2
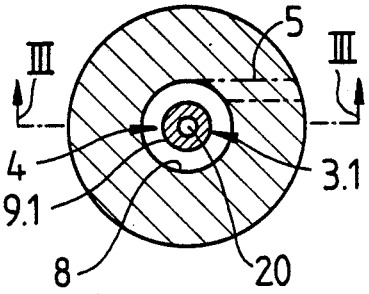
Fig. 4

Fig. 5
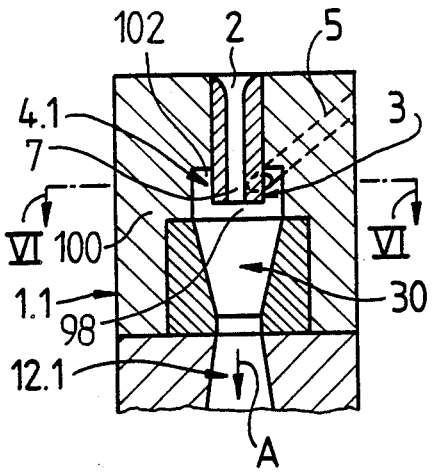
Fig. 7
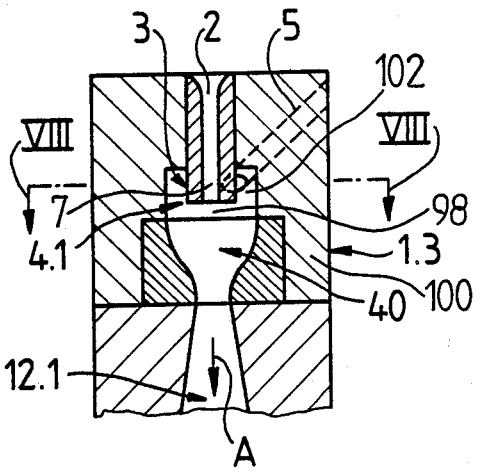
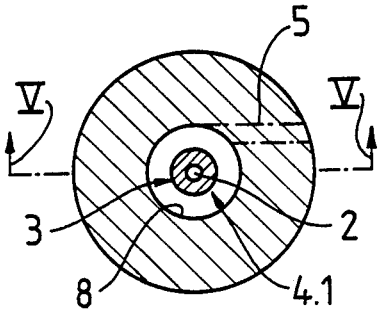
Fig. 6
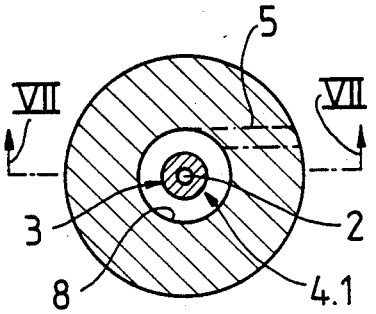
Fig. 8

METHOD OF PRODUCING A ROTATING AIR LAYER AND FALSE-TWIST AIR JET NOZZLE FOR PRACTICING SUCH METHOD

BACKGROUND OF THE INVENTION

The present invention relates to a new and improved method for producing a rotating or revolving air layer and, furthermore, pertains to a new and improved false-twist air jet nozzle including at least one twist nozzle for the practice of the method and for producing a false or fluid twisted yarn.

At this point it is observed that in the context of this disclosure, the term "twisted fiber structure" or equivalent expressions, are used in their broader sense to encompass not only a mass of fibers or fiber material to which twist has been applied but also yarn-like structures containing twist and from which there is ultimately produced a yarn.

Generally speaking, the method of the present invention for producing a rotating or revolving air layer is of the type which contemplates producing such rotating air layer in a twist-producing part or component of a twist nozzle of a false-twist air jet nozzle and using such rotating air layer for placing a twisted fiber structure or yarn-like structure into rotational or rotary movement.

As to the false-twist air jet nozzle of the present invention, sometimes also simply briefly referred to as an air jet nozzle, such is of the type containing at least one twist nozzle generally comprising a central inlet duct or channel through which there is infed the twisted fiber structure or the like and which is followed by a twist-producing part or component of generally round cross-section. There is further provided at least one air injection means or air injection nozzle in this twist-producing part or component for the injection of an air flow or stream in order to form a rotating air layer in such twist-producing part or component and for sucking the twisted fiber structure or the like into such twist-producing part or component.

An air jet nozzle of this kind is known from German Published Patent Application No. 2,722,319, published Jan. 15, 1981, the European Published Patent Application No. 0,131,170, published Jan. 16, 1985, and German Published Patent Application No. 3,526,514, published Feb. 6, 1986. These documents demonstrate that such air jet nozzles are used as so-called false-twist nozzle in combination with a drafting arrangement. The drafting arrangement delivers a sliver which is subdivided into core fibers and edge fibers. The twist nozzle or, as in the case of the last-mentioned patent document, the second twist nozzle as considered in the direction of yarn movement or travel, rotates the yarn core fibers so as to form a false-twisted yarn core which extends from substantially the twist-producing part or component of this twist nozzle up to the delivery rolls of the drafting arrangement. The air inlet duct or, as in the case of the last-mentioned patent document, the first air jet or twist nozzle as considered in the direction of yarn movement or travel, guides the edge fibers towards the false-twisted yarn core and wraps these edge fibers around the false-twisted yarn core. These fibers which have been wound around the yarn core are designated as wrapping fibers which wrap around the yarn core which is again rotated back or unrotated (and which unrotated yarn has substantially parallel fibers) after departing from the twist-producing part or component of the twist nozzle and thus impart to the yarn the required strength.

It will therefore be readily understood that the fiber feed to the false-twisted yarn core and the subsequent wrapping operation are carried out such that even after the yarn core has been rotated back into its neutral position (in which the fibers lie substantially in the longitudinal direction in the yarn) the wrapping fibers bear sufficiently snugly and with sufficient wraps or convolutions against the yarn core to impart to the yarn the required strength.

It will be apparent from the disclosures of the aforementioned published patent documents that air injection nozzles lead into the twist-producing part of the false-twist air jet nozzle and are directed such that a rotation is imparted to the yarn core arriving from the drafting arrangement. In particular, the yarn core is brought into contact with the inner wall of the twist-producing part by the rotating air flow and the resulting centrifugal force, so that a crank effect or action occurs at the yarn core and imparts to such yarn core the false twist or, where two twist nozzles are used in series or succession, i.e. one after the other in the direction of yarn movement or travel, as disclosed in German Patent No. 3,237,990, published Mar. 13,.1986, the first twist nozzle places the edge fibers against the false-twisted yarn core.

In recognition of the fact that this air flow alone contributes to the aforenoted crank formation or action, and thus, rotation of the yarn core, particular attention has been devoted to such air flow during the course of examining and analyzing such air flow in order to optimize the energy required from the air flow in terms of imparting rotation to the yarn core and to achieve an economical spinning operation. In terms of economic considerations such should be limited to a comparison between energy consumption and spinning speed.

The person skilled in the art concerned with this spinning technique is aware that the air flow must not only impart rotation to the yarn or twisted fiber structure, but also a feed or forwarding effect to the yarn or twisted fiber structure in the direction of yarn movement or travel in order to produce a thread tension component in the false-twisted yarn core.

It is also known from the aforementioned European Published Patent Application No.0,131,170, as shown in FIGS. 4 to 5*a*, that the air sucked into the inlet duct is sucked away in front of the constriction or throttle location. It is therefore necessary for the air flow to also produce a suction effect in the twist-producing part, apart from the aforenoted yarn rotation and yarn forwarding action, in order to suck air sufficiently through the inlet duct by the air flow flowing into the feed duct, in order to prevent the fiber ends bearing against the false-twisted yarn core from migrating towards the suction produced in the inlet duct.

SUMMARY OF THE INVENTION

Therefore with the foregoing in mind it is a primary object of the present invention to provide a new and improved method and apparatus for false-twist or jet spinning a twisted fiber structure or the like in order to produce a yarn in a manner which does not exhibit the aforementioned drawbacks and shortcomings of the prior art.

Another and more specific object of the present invention aims at providing a new and improved method and apparatus for false-twist or jet spinning a twisted fiber structure or the like in a manner such that the air flow has an optimum form in respect of economy of usage of the available energy of the air flow and imparting rotation to the twisted fiber structure or the like from which there is ultimately produced a yarn.

Yet a further significant object of the present invention aims at providing a new and improved false-twist air jet nozzle which is quite simple in construction and design, relatively economical to fabricate and exceedingly reliable in operation.

Another noteworthy object of the present invention aims at the provision of an improved method and apparatus for false twist spinning a twisted fiber structure or the like by infeeding air tangentially and at an inclination with respect to the direction of travel or forwarding of the twisted fiber structure from which there is to be ultimately produced a yarn and from which infed air there is formed a rotating air layer before contacting the twisted fiber structure, the rotating air layer producing increased axial forces in such twisted fiber structure and imparting a greater rotational action upon the twisted fiber structure.

Now in order to implement these and still further objects of the invention which will become more readily apparent as the description proceeds, the method aspects of the present invention, among other things, are manifested by the features that air is infed into the twist-producing part tangentially and at an inclination with respect to a predetermined direction of travel or forwarding of the twisted fiber structure, and there is formed from the infed air a rotating air layer before such rotating air layer engages or contacts the twisted fiber structure.

As already indicated, the present invention is not only concerned with the aforementioned method aspects, but further pertains to an improved construction of false-twist air jet nozzle. Such false-twist air jet nozzle, among other things, is manifested by the features that it comprises at least one twist nozzle, the twist-producing part or component of which is provided with air guide means such that the air flow is formed into a rotating or revolving air flow before it engages with the sucked-in twisted fiber structure. At least one air injection nozzle flow communicates with the twist-producing part or component and infeeds the air or air flow tangentially and at an inclination with respect to the direction of travel or forwarding of the twisted fiber structure.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 1 is a semi-diagrammatic view of a twist nozzle of a false-twist air jet nozzle and shown in fragmentary section taken substantially along the line I—I of FIG. 2;

FIG. 2 is a top plan and sectional view of FIG. 1 taken substantially along the line II—II thereof;

FIG. 3 is a semi-diagrammatic view of a further embodiment of twist nozzle of a false-twist air jet nozzle shown in fragmentary section taken substantially along the line III—III of FIG. 4;

FIG. 4 is a top plan and sectional view of FIG. 3 taken substantially along the line IV—IV thereof;

FIG. 5 is a semi-diagrammatic view of a further embodiment of twist nozzle of a false-twist air jet nozzle shown in fragmentary section taken substantially along the line V—V of FIG. 6;

FIG. 6 is a top plan and sectional view of FIG. 5 taken substantially along the line IV—IV thereof;

FIG. 7 is a semi-diagrammatic view of a further embodiment of twist nozzle of a false-twist air jet nozzle according to the invention shown in fragmentary section taken substantially along the line VII—VII of FIG. 8;

FIG. 8 is a top plan and sectional view of FIG. 7 taken substantially along the line VIII—VIII thereof;

DETAILED DESCRIPTION OF THE PREFERRED EMBODIMENTS

Figure 9:
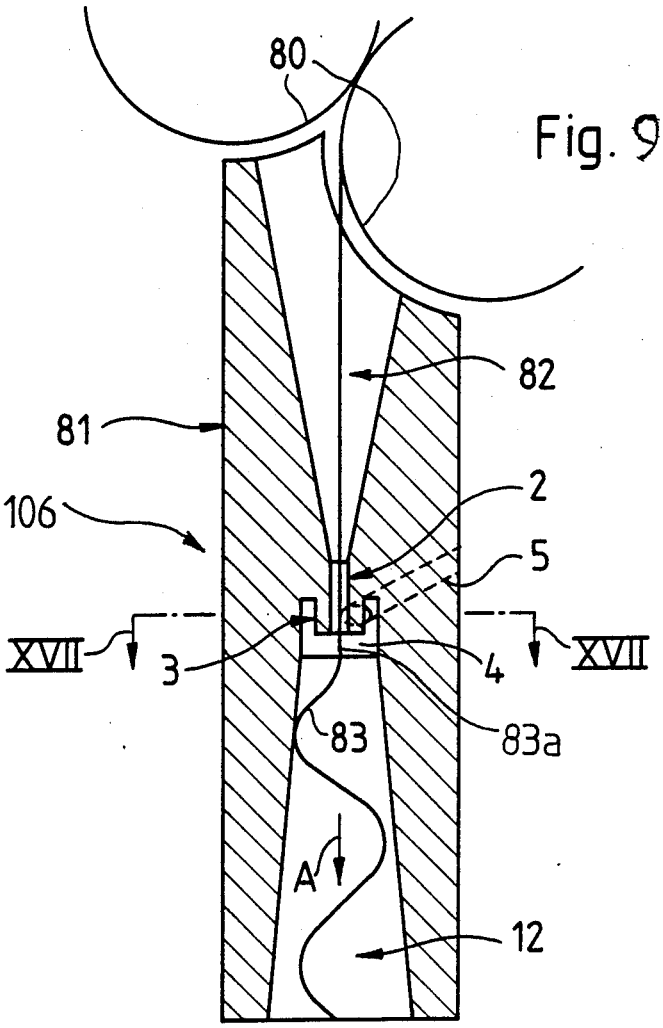
FIG. 9 is a semi-diagrammatic view of a false-twist air jet nozzle or nozzle arrangement using a single twist nozzle constructed according to the invention and depicted in section taken substantially along the line XVI—XVI of FIG. 10.

Describing now the drawings, it is to be understood that to simplify the illustration thereof only enough of the construction of the various embodiments of false-twist air jet nozzles and specifically the twist nozzles thereof has been shown as needed for those skilled in the art to readily understand the underlying principles and concepts of the present development. Turning attention now to the first exemplary embodiment of twist nozzle for use in a false-twist air jet nozzle and depicted in FIGS. 1 and 2, it will be seen that there is specifically shown a twist nozzle 1 of a false-twist air jet nozzle or nozzle. This twist nozzle 1 comprises an inlet or suction duct or channel 2 for a twisted fiber structure or yarn-like structure and which defines the internal diameter of a tube or tubular member 2*a*. The tube or tubular member 2*a* has a tube or tubular extension 3 which projects by a length 1 into a substantially cylindrical cavity or space 4 provided in the twist nozzle 1 and specifically into the inlet zone or region 98 of the twist-producing part or component 100 thereof.

An air injection nozzle or duct 5 or equivalent structure having an air exit or outlet opening 6 also leads into the substantially cylindrical cavity or space 4 of the twist-producing part or component 100 in such manner that, with respect to the showing of FIG. 1, the exit or outlet opening 7 for the twisted fiber structure and located at the lower or free end of the inlet or suction duct 2 is at a lower level than or extends beyond the air exit or outlet opening 6 of the air injection nozzle 5. As a result, an annular air guide or guide means 102 for the air flow or compressed air injected by the air injection nozzle 5 is formed between the substantially cylindrical inner wall 8 of the substantially cylindrical cavity or space 4 of the twist-producing part 100 and the substantially cylindrical outer wall 9 of the tube or tubular extension 3.

With further attention to FIG. 1, it will be recognized the air injection nozzle 5 is, on the one hand, disposed at an inclination such that the axis of symmetry or lengthwise axis 10 of this air injection nozzle 5 forms an angle α with an imaginary plane 11 which intersects the axis of symmetry 10 and, looking towards FIG. 1, is disposed substantially perpendicular to the sectional plane of such FIG. 1 and the lengthwise axis of the twist nozzle 1, and, on the other hand, as shown in FIG. 2, leads tangentially into the substantially cylindrical cavity or space 4. This tangential inclined position of the air injection nozzle 5 results in the injected air flow or air producing an air layer which revolves or rotates along the substantially cylindrical wall 8 and migrates in the direction of the arrow A of FIG. 1.

As a result of the air flow direction A, a negative pressure or suction is produced in the inlet or suction duct 2, based upon the well known jet pump principle, and sucks air through the inlet duct 2 in the direction of the arrow A.

As is known from the previously discussed prior art, as a result of this air which is sucked in through the inlet duct 2 the twisted fiber structure or the like is sucked through the inlet duct 2 and is engaged by the rotating air layer. If the twist nozzle 1 is used as a false-twist nozzle, as mentioned in the aforediscussed prior art, a centrifugal force is exerted at the engaged yarn core and deflects or displaces the latter in the form of a crank or with a crank motion or action. As is readily apparent from the aforenoted German Patent Publication No. 2,722,319, a yarn core deflected in this way rotates in the fashion of a rotating crank so that a twist is produced in the yarn core.

In the aforenoted prior art, the tube or tubular extension 3 projecting by the length 1 is absent, and the air injection nozzles are mounted or arranged such that the yarn core rotating in the manner of a crank has an adverse effect on the build-up of the rotating air layer, since the air exit or outlet opening is periodically covered or obstructed by the rotating yarn crank or crank-like rotating twisted fiber structure or yarn-like structure, since the incoming air is not forced to form a rotating air layer before it engages or contacts the yarn core.

The result of this disadvantageous action is that for the same quantity of air and the same air injection speed the rotation of the yarn core is less and the suction effect is less than in the case where there is used the tube or tubular extension 3 as contemplated according to the invention. Since, on the other hand, the air injection nozzle must be made substantially cylindrical for practical reasons, in the optimum case the speed of the injected air can correspond to the speed of sound.

If this air speed is further disturbed or reduced by constructions carried out in accordance with the teachings of the prior art, then losses occur in respect of the efficiency of the available energy of the injected air.

As is known from the prior art, wrapping fibers are wound around the rotating yarn core and, even after the untwisting of the false-twisted yarn core, such wrapping or wrap fibers ensure that the yarn core fibers which are disposed substantially in the direction of the lengthwise axis of the yarn are held together in order to thus produce a usable yarn.

As will be apparent from the prior art, a yarn of this kind is typically withdrawn by a pair of withdrawal rolls and is fed to a winder. The withdrawal of the yarn by means of the aforementioned pair of yarn withdrawal rolls, on the one hand, and the aforedescribed rotation of the false-twisted yarn, on the other hand, results in a so-called helix formation in the yarn in the zone or region following the substantially cylindrical cavity or space 4, i.e. after or downstream of the twist-producing part 100 of the twist nozzle 1, and this helix formation of the yarn continuously decreases towards the pair of yarn withdrawal rolls.

In order to guide such a yarn helix, the substantially cylindrical cavity or space 4 is followed at least initially, as considered in the direction of the arrow A, by a diffusor-like widening cone or conical portion 12 which has a predetermined length.

It is here further observed that for the various embodiments of twist nozzle as proposed by the present invention, it has been found advantageous if the tube or tubular extension 3 axially extends or protrudes beyond the air exit or outlet opening 6 of the air injection nozzle 5 by an amount which generally does not exceed about one-half the diameter of the air exit or outlet opening 6. In this way it is possible to desirably minimize the air drag loss or friction loss. By infeeding the air tangentially inclined into the substantially cylindrical cavity or space 4 of the twist-producing part or component 100 at the aforementioned angle α or, stated in a somewhat different way, at a predetermined angle which is the complement of the angle α with respect to the lengthwise axis of the twist nozzle, there also beneficially results in less air drag or resistance prevailing at the walls of the twist-producing part. Consequently, there is realized a higher efficiency of the air, that is to say, less air is needed to attain the same effect. As a result, the infed compressed air imparts a greater rotational action upon the twisted fiber structure and also exerts greater axial forces in the twisted fiber structure, in other words, exerts a force component in the direction of travel of the twisted fiber structure and the yarn formed therefrom. It is here further mentioned that the portion of the twisted fiber structure which departs from the exit or outlet opening 7 of the inlet or suction duct 2 forms a balloon which does not contact the inner wall of the twist-producing part or component 100, thus producing the desirable result that frictional forces do not act at this initial ballooning portion of the twisted fiber structure and greater axial forces are desirably exerted in the twisted fiber structure and higher rotational speeds of such twisted fiber structure beneficially result.

Figure 10:
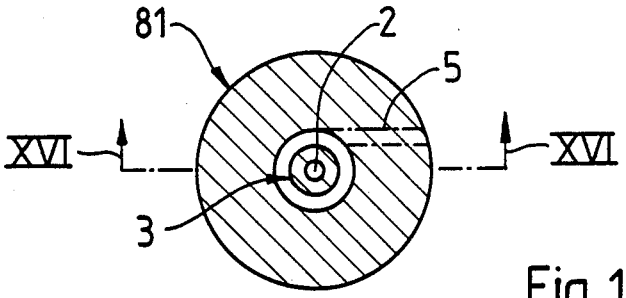
FIG. 10 is a cross-sectional view of the false-twist air et nozzle depicted in FIG. 9, taken substantially along the section line XVII—XVII thereof.

It is further mentioned that if a single twist nozzle, such as the twist nozzle 1 of FIGS. 1 and 2 is used in a false-twist air jet nozzle, as shown for the arrangement of FIGS. 9 and 10, then it has been found advantageous if the diameter difference ratio or diameter ratio between the internal diameter of the tube or tubular extension 3 at the region of the exit or outlet opening 7 and the internal diameter of the substantially cylindrical cavity or space 4 is in a range of approximately 0.35 to 0.5, and preferably amounts to about 0.42. There has been used, for instance, a diameter ratio of about 0.5 for a single twist nozzle system. It is here also noted that in such a single twist nozzle system the aforementioned angle α typically lies in a range of 35° to 45°, and preferably in the range of 35° to 40°.

Figure 11:
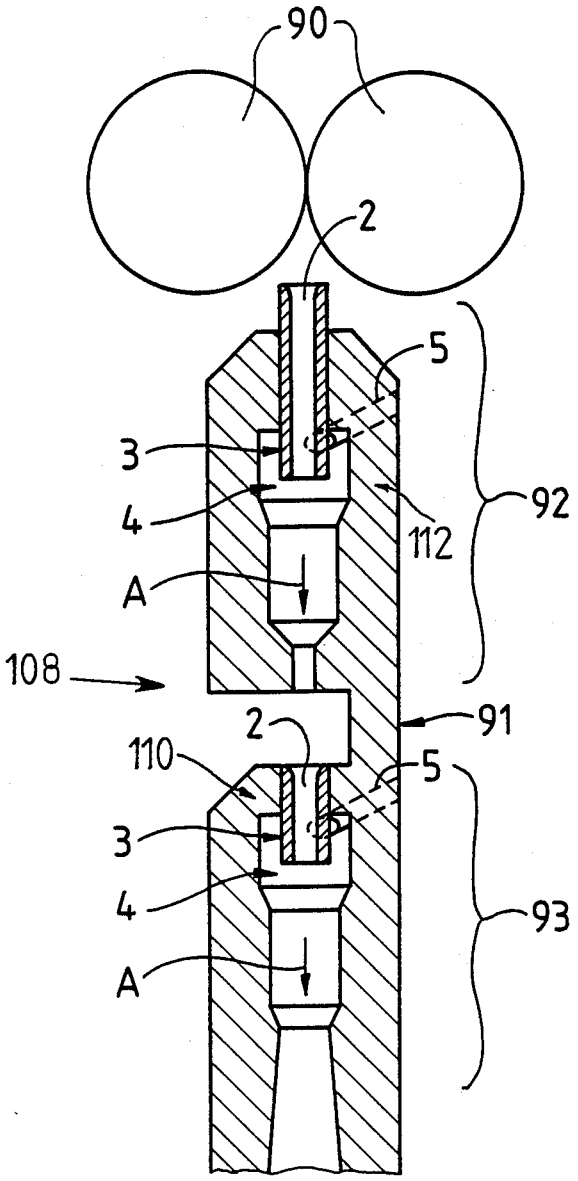
FIG. 11 is a longitudinal section of a further construction of false-twist air jet nozzle or nozzle arrangement employing two twist nozzles constructed according to the invention.

When using a two nozzle system for the false-twist air jet nozzle or nozzle arrangement as shown, for instance, in FIG. 11, that is to say, when using two successively spacedly arranged twist nozzles defining an upstream twist nozzle and a downstream twist nozzle, then the aforementioned diameter difference ratio or diameter ratio advantageously amounts to approximately 1:1 for the first or upstream located twist nozzle, and for the second or downstream twist nozzle such diameter difference ratio or diameter ratio advantageously is in a range of 0.5 to 0.8, and preferably amounts to about 0.6. Also in such a two nozzle system the aforementioned angle $\alpha$ for the first or upstream nozzle lies, for instance, in a range of 40° to 60°, preferably amounts to about 50°, and as to the second or downstream twist nozzle the aforenoted angle $\alpha$ can assume values like in a single nozzle system as previously explained, in other words, lie in the range of 30° to 45°.

The following FIGS. 3 to 8 inclusive show variants of the twist nozzle according to the invention, so that the same or substantially the same elements or components have been generally designated by the same reference characters or numerals or by a reference numeral which has been increased by a digit following a decimal point. At the same time, the dimensions shown for such elements may vary from one figure to the next.

With the foregoing in mind, it will be recognized that FIGS. 3 and 4 show a twist nozzle 1 for use in a false-twist air jet nozzle and which is basically constructed like the embodiment of FIGS. 1 and 2 previously discussed, but here comprising an inlet or suction duct 20 which, unlike the substantially cylindrical shape shown in the arrangement of FIG. 1, here has a shape at least similar to a Venturi nozzle or tube i.e. has converging and diverging portions.

The advantage of this Venturi or Venturi-nozzle or tube shape is the smaller resistance to the quantity of air which is to be sucked through, and also affords the possibility of making the narrowest duct cross-section or throat narrower for the same air resistance in order to thus prevent, as required, any balloon formation above the twist nozzle as viewed with respect to the showing of FIG. 3.

Furthermore, the indicated length 1.1 demonstrates that the tube or tubular extension 3.1 penetrating into the substantially cylindrical cavity or space 4 projects further into this substantially cylindrical cavity or space with a length 1.1 than with the length 1 depicted for the prior discussed embodiment of FIGS. 1 and 2.

FIGS. 5 and 6 illustrate another embodiment of twist nozzle for a false-twist air jet nozzle, in which the substantially cylindrical cavity or space 4.1 is followed, as considered in the direction indicated by the arrow A, by a narrowing or converging cone or conical portion 30 having a substantially linear generatrix, by means of which the rotating air layer of the air injected by the air injection nozzle 5 and which rotating air layer is formed in the substantially cylindrical cavity or space 4.1 is constricted. As a result, the speed of this rotating air layer is increased, with the advantage that the twisted fiber structure or the like engaged by the air layer also rotates at a correspondingly higher speed.

Another advantage of this embodiment is that the constriction of the air layer causes the twisted fiber structure which has been sucked in through the inlet or suction duct 2 to come more rapidly into contact with the rotating air layer.

The narrowing or converging cone or conical portion 30 is followed by a widening or diverging cone or conical portion 12.1 which has the same function as the cone or conical portion 12 of the embodiments of FIGS. 1 and 3 which have been heretofore discussed.

FIGS. 7 and 8 depict a variant of the embodiment of FIGS. 5 and 6, in which the cone or conical portion 30 of FIG. 5 is here replaced by a converging or constricted portion 40 which together with the following or downstream located diverging cone or conical portion 12.1 has a shape similar to a Venturi nozzle or tube and generally works according to such principle.

The advantage of this shape is the same as that of the Venturi nozzle, i.e. to improve the resistance to the passage of the air flow in the direction of the arrow A and to provide a smoother transition from the narrowing or converging cone or conical portion 40 to the widening or diverging cone or conical portion 12.1.

FIGS. 9 and 10 show a possible use of the twist nozzle shown in FIGS. 1 and 2 in a false-twist air jet nozzle or nozzle arrangement, although it should be understood that all the different constructions of twist nozzles shown and described with reference to FIGS. 1 to 8 could be used in this nozzle arrangement.

The embodiment shown in FIGS. 9 and 10 corresponds to a modification according to the invention of the false-twist nozzle shown in the aforementioned German Publication No. 2,722,319. Instead of this nozzle it would also be possible to use inventive modifications of the twist nozzles shown in the likewise aforementioned European Patent Application No. 0,131,170.

FIG. 9 illustrates a pair of delivery rolls 80 of a drafting arrangement which has not otherwise been shown in detail and a false-twist nozzle body 81 of a false-twist air jet nozzle 106.

As considered in the feed or air flow direction A the false-twist nozzle body 81 comprises a feed or infeed duct or channel 82, the inlet or suction duct 2 with the tube or tubular extension 3, the substantially cylindrical cavity or space 4, the at least one air injection nozzle 5, and a widening or diverging cone or conical portion 12 connected to or flow communicating with the substantially cylindrical cavity or space 4.

The air layer rotating in the substantially cylindrical cavity or space 4 places the yarn core 83 of the twisted fiber structure **83*a* into rotation, as already described in the aforementioned prior art, so that a false-rotation or false-twist forms therein and such extends towards the pair of delivery rolls 80**.

The twisted fiber structure **83*a* or the like undergoes the formation of a helix in the widening or diverging cone or conical portion 12 followed by untwisting of the yarn core 83. The yarn ultimately produced from the thus processed twisted fiber structure 83*a*** is then withdrawn by a pair of conventional withdrawal rolls and fed to a suitable winder.

FIG. 11 shows another possible use of the different embodiments of twist nozzles illustrated in FIGS. 1 to 8. The here shown exemplary embodiment depicts a false-twist air jet nozzle of the type disclosed in the aforementioned German Patent Publication No. 3,526,514, but modified in accordance with the teachings of the present invention. In the illustrated exemplary arrangement, there will be recognized a pair of delivery rolls 90 of a here not further shown but conventional drafting arrangement and a false-twist nozzle body 91 of a false-twist air jet nozzle or nozzle arrangement 108. This false-twist nozzle body 91 will be seen to comprise a first twist nozzle zone or region 92 and a second twist nozzle zone or region 93 located downstream or after the first twist nozzle zone or region 92.

The second twist nozzle 110 of the second twist nozzle zone 93 is used to produce a false-twisted yarn core which extends in known manner towards the pair of delivery rolls 90, while the first twist nozzle 112 of the first twist nozzle zone 92 serves in a manner known as such to wrap the edge fibers around the false-twisted yarn core.

In connection with this embodiment it should be noted that although the twist nozzle of FIGS. 1 and 2 has been used as an example in this variant, all the other variants of twist nozzles can be used, whether such be in the first or second nozzle zones 92 and 93.

For the sake of simplicity the other details of this variant embodiment will not be here further explained since the same is not believed to be necessary for understanding the underlying principles and concepts of the invention and in any event reference also may be readily had to the previously discussed prior art in this context and the disclosure of which is thus conveniently incorporated herein by reference.

Finally, it should be noted that variations from one another can be selected within the exemplary embodiments depicted in FIGS. 1 to 8, for example the inlet or suction duct 20 can also be used in the other embodiments.

Also, the exemplary embodiments illustrated and heretofore discussed are not restricted to the use of a single air injection nozzle 5 or the like, and it is possible, of course, to use a plurality of equidistantly or uniformly distributed air injection nozzles 5 or air injection nozzles 5 distributed non-uniformly at the periphery of the related twist nozzle.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A false-twist air jet nozzle, comprising:

at least one twist nozzle;

said twist nozzle comprising:

an inlet duct;

a twist-producing part of generally round cross-section following said inlet duct with respect to a predetermined direction of travel of a twisted fiber structure;

at least on air injection means provided in said twist-producing part for the injection of an air flow to form a rotation air layer in said twist-producing part and for sucking the twisted fiber structure into said twist-producing part;

said at least one air injection means extending tangentially and at an inclination with respect to a lengthwise axis of said twist-producing part;

said twist-producing part comprising air guide means for causing the air flow to form a rotating air layer before said rotating air layer engages the sucked-in twisted fiber structure;

two of said twist nozzles being successively arranged in series as considered in said predetermined direction of travel of the twisted fiber structure;

said two twist nozzles respectively defining an upstream twist nozzle and a downstream twist nozzle with respect to said predetermined direction of travel of the twisted fiber structure;

said inlet duct of said downstream twist nozzle having an outlet opening having a predetermined diameter;

said twist-producing part of said downstream twist nozzle having an inlet zone arranged adjacent said outlet opening of said inlet duct of said downstream twist nozzle;

said inlet zone of said downstream twist nozzle having a predetermined diameter; and the ratio of the predetermined diameter of said outlet opening of said downstream twist nozzle and the predetermined diameter of the inlet zone of said downstream twist nozzle lying in a range of approximately 0.5 to 0.8.

2. The false-twist air jet nozzle as defined in claim 1, wherein:

said air injection means of each one of said two twist nozzles comprises an air injection nozzle which extends tangentially and at an inclination into the twist-producing part with respect to the lengthwise axis of the twist-producing part;

said twist-producing part having an inner wall;

said air guide means comprises tube means having an outer wall; and said tube means extending into said twist-producing part such that said air flow experiences guidance between the inner wall of said twist-producing part and the outer wall of the tube means.

3. The false-twist air jet nozzle as defined in claim 2, wherein:

said twist-producing part has an inlet zone;

said air injection nozzle has an air outlet opening; and said tube means projecting into said inlet zone at least to an extent that said tube means at least overlies in spaced relationship the air outlet opening of said air injection nozzle.

4. The false-twist air injection nozzle as defined in claim 3, wherein:

said air outlet opening has a predetermined diameter; and said tube means extends beyond the air outlet opening through a length corresponding approximately to one-half of said predetermined diameter of said air outlet opening.

5. The false-twist air jet nozzle as defined in claim 3, wherein:

said outer wall of said tube means and said inner wall of said twist-producing pat are each substantially cylindrical.

6. The false-twist air jet nozzle as defined in claim 5, wherein:

said air injection nozzle is arranged such that said air flow flows substantially along said inner wall of said twist-producing part at the region of said inlet zone; and the distance between said inner wall of said twist-producing part at the region of said inlet zone and said outer wall of said tube means is selected such that the air flow, as considered in a peripheral direction of the twist-producing part, after flowing into said inlet zone flows through a region of substantially constant cross-sectional area.

7. The false-twist air jet nozzle as defined in claim 5, wherein:

said twist-producing part is provided with a converging portion downstream of said substantially cylindrical inner wall in each one of said two twist nozzles.

8. The false-twist air jet nozzle as defined in claim 7, further including:

a diverging portion arranged following said converging portion in said downstream twist nozzle.

9. The false-twist air jet nozzle as defined in claim 8, wherein:

said converging portion and said diverging portion coact with one another to define substantially a Venturi nozzle.

10. The false-twist air jet nozzle as defined in claim 1, wherein:

said inlet duct of each one of said two twist nozzles possesses a substantially cylindrical configuration.

11. The false-twist air jet nozzle as defined in claim 1, wherein:

said inlet duct of at least one of said two twist nozzles has a configuration which defines substantially the shape of a Venturi nozzle.

12. The false-twist air jet nozzle as defined in claim 1, wherein:

each one of said two twist nozzles has a lengthwise axis; and said air injection means have a lengthwise axis which encloses an angle in the range of 30° to 60° with respect to a plane extending substantially perpendicular to the lengthwise axis of the twist nozzle.

13. The false-twist air jet nozzle as defined in claim 1, wherein:

said ratio amounts to about 0.6.

14. The false-twist air jet nozzle as defined in claim 1, wherein:

said inlet duct of said upstream twist nozzle has an outlet opening having a predetermined diameter;

said twist-producing part of said upstream twist nozzle has an inlet zone arranged adjacent said outlet opening of said inlet duct of said upstream twist nozzle;

said inlet zone of said upstream twist nozzle having a predetermined diameter; and the ratio of the predetermined diameter of said outlet opening of said upstream twist nozzle and the predetermined diameter of the inlet zone of said upstream twist nozzle amounting to approximately 1.

15. The false-twist air jet nozzle as defined in claim 1, wherein:

said two twist nozzles are substantially identical to one another.

16. The false-twist air jet nozzle as defined in claim 1, wherein:

said two twist nozzles are of different construction with respect to one another.

17. A false-twist air jet nozzle, comprising:

at least one twist nozzle;

said twist nozzle comprising:

an inlet duct;

a twist-producing part of generally round cross-section following said inlet duct with respect to a predetermined direction of travel of a twisted fiber structure;

at least one air injection means provided in said twist-producing part for the injection of an air flow to form a rotating air layer in said twist-producing part and for sucking the twisted fiber structure into said twist-producing part;

said at least one air injection means extending tangentially and at an inclination with respect to a lengthwise axis of said twist-producing part;

said twist-producing part comprising air guide means for causing the air flow to form a rotating air layer before said rotating air layer engages the sucked-in twisted fiber structure;

means defining a feed duct for infeeding a twisted fiber structure to said twist nozzle and from which there is ultimately formed a yarn;

said twist nozzle constituting a sole twist nozzle of the false-twist air jet nozzle;

said infeed duct having an outlet opening having a predetermined diameter;

said twist-producing part having an inlet zone arranged adjacent said outlet opening of said infeed duct;

said inlet zone having a predetermined diameter;

the ratio of the predetermined diameter of said outlet opening and the predetermined diameter of the inlet zone lying in a range of approximately 0.35 to 0.5; and said ratio amounting to about 0.42.

* * * * *